US005377779A

United States Patent [19]

Slapnicka

[11] Patent Number: 5,377,779

[45] Date of Patent: Jan. 3, 1995

[54] SELF-STOWABLE SAWHORSE WITH BEAM-SUPPORTING SADDLES

[76] Inventor: Elden R. Slapnicka, 765 Oak Knoll Dr., Ashland, Oreg. 97520

[21] Appl. No.: 241,741

[22] Filed: May 11, 1994

[51] Int. Cl.[6] ..... E04G 1/00

[52] U.S. Cl. ..... 182/153; 182/155

[58] Field of Search ..... 182/153, 181, 151, 154, 182/224, 155, 185, 186, 226; 248/432

[56] References Cited

U.S. PATENT DOCUMENTS

| | | | |
|---|---|---|---|
| 787,922 | 4/1905 | Hoxie | 182/186 X |
| 1,450,869 | 4/1923 | Reinelt | 182/153 |
| 1,982,061 | 11/1934 | Marlowe | 182/186 |
| 2,698,771 | 1/1955 | O'Rourk | 182/181 X |
| 3,144,914 | 8/1964 | Tjosvoll | 182/155 |
| 3,330,534 | 7/1967 | Collins | 182/181 X |
| 3,446,312 | 5/1969 | Jones | 182/226 |
| 3,830,340 | 8/1974 | Schäffel | 182/186 X |
| 4,457,399 | 7/1984 | Breisch | 182/224 X |
| 4,496,028 | 1/1985 | Peterson | 182/186 |
| 4,880,080 | 11/1989 | Brockman | 182/155 |

FOREIGN PATENT DOCUMENTS

| | | | |
|---|---|---|---|
| 624325 | 7/1961 | Canada | 182/186 |
| 8040 | 5/1900 | United Kingdom | 182/186 |

OTHER PUBLICATIONS

*Official Gazette*, Mar. 24, 1970, p. 1157 listing Patent No. 3,502,174.

*Official Gazette*, Sep. 5, 1989, p. 753 listing Des. Pat. No. 303,293.

*Official Gazette*, Oct. 14, 1980, p. 862 listing Des. Pat. No. 257,395.

*Official Gazette*, Nov. 15, 1988, p. 1593 listing Des. Pat. No. 298,571.

*Official Gazette*, Oct. 11, 1988, p. 1028 listing Des. Pat. No. 298,056.

*Official Gazette*, Mar. 14, 1989, p. 1278 listing Des. Pat. No. 300,251.

*Official Gazette*, Apr. 25, 1989, p. 2871 listing Des. Pat. No. 300,861.

*Official Gazette*, Feb. 27, 1990, p. 2577 listing Des. Pat. No. 306,349.

*Official Gazette*, Jun. 19, 1990, p. 2017 listing Des. Pat. No. 308,728.

*Official Gazette*, Feb. 26, 1991, p. 2589 listing Des. Pat. No. 315,025.

*Official Gazette*, Jul. 28, 1992, p. 2713 listing Des. Pat. No. 328,355.

*Official Gazette*, date unknown, p. 2070 listing Des. Pat. No. 329,502.

*Official Gazette*, Jun. 19, 1984, p. 1304 listing Des. Pat. No. 274,365.

*Official Gazette*, Sep. 21, 1982, p. 1187 listing Des. Pat. No. 266,274.

*Primary Examiner*—Karen J. Chotkowski

*Attorney, Agent, or Firm*—Edward B. Anderson

[57] ABSTRACT

Included are a work beam, legs and saddle assemblies made primarily of commercially available plastic pipe, such as PVC and ABS pipe. The work beam is elongate, hollow, tubular, and rigid. The ends of the beam are closed by caps, at least one of which is removable for providing access to the interior of the beam. Pair of legs are pivotingly coupled together at an intermediate point of each leg. Caps removably mountable on ends of the legs support an arcuate, resilient saddle element. Two brace rods are associated with each leg assembly. The legs, saddle assemblies and rods are all sized to fit collectively inside the beam.

5 Claims, 3 Drawing Sheets

SELF-STOWABLE SAWHORSE WITH BEAM-SUPPORTING SADDLES

BACKGROUND OF THE INVENTION

1. Field of the Invention

This invention relates to movable frames or trestles used for supporting a work piece. Such a frame, used for holding a piece of wood being sawed, is referred to as a sawhorse. As used herein, reference to the common term sawhorse also includes reference to similar movable frames, for whatever particular purpose intended. In particular, this invention is directed to, a sawhorse that has the various features of being collapsible, has a hollow work beam for stowing items, such as the other parts of the sawhorse, and includes a saddle mounted on the top of leg assemblies for supporting the work beam.

2. Related Art

Various designs of sawhorses are known to exist. The basic carpenters sawhorses have been made of wood with legs nailed to a work beam. Such a sawhorse is fixedly assembled and must be stored and moved in its completed form.

Hardware pieces are also commercially available for securing pieces of lumber together to form a sawhorse. These may provide for either permanent or disassembleable sawhorses. If they are disassembleable, there is no convenient way to keep the various parts together.

As a result, various designs have been developed to make storage and transportation of sawhorses more convenient. These include designs that provide for pivoting of the legs relative to each other and relative to the work beam to allow them to collapse. It is also known to provide means for attaching pieces together so that they can be disassembled. Such designs typically are somewhat expensive in that specially machined or manufactured parts are required.

Some designs are also known in which a work beam is replaceable. Some of these designs use the work beam as part of the support structure, and others do not.

Sawhorses also typically serve a single function, that of providing an elevated horizontal work beam. Some designs have been developed that have built-in tool shelves, and some also provide steps for use of the unit as a step ladder.

There remains the need for a sawhorse that can be completely disassembled and stored in a container, and particularly a sawhorse having a built-in container for storing its parts. There also is a need for a sawhorse that is inexpensive to make and which can be assembled without tools to form a lightweight, yet rigid sawhorse.

SUMMARY OF THE INVENTION

These features are provided in the present invention by a sawhorse having leg assemblies that include an upwardly facing saddle for receiving a work beam. Means is provided for securing each leg assembly relative to the work beam.

This invention also provides a sawhorse in which the work beam forms a container. When the sawhorse is disassembled, this container may be used to stow the disassembled parts.

In the preferred embodiment of the invention, the sawhorse is collapsible and self-stowing. It is made primarily of lightweight, commercially available plastic pipe, such as PVC and ABS pipe. The work beam is elongate, hollow, tubular, and rigid. The ends of the beam are closed by caps, at least one of which is removable for providing access to the interior of the beam. Each leg assembly has a pair of elongate, tubular legs that are shorter than the work beam and have foot ends and beam-support ends. Each pair of legs is pivotingly coupled together at an intermediate point of each leg. The legs in each leg assembly may thus be pivoted for aligning them in adjacent parallel relationship.

A saddle assembly for each leg assembly holds the beam between spaced-apart beam-support ends of the legs. Each saddle assembly has caps removably mountable on the beam-support ends of the legs. An arcuate, resilient saddle element has a circumferential length greater than 180° and a diameter corresponding to the diameter of the beam. The caps are attached to the saddle element at spaced-apart locations so that when the caps are on the legs the saddle element is open upwardly for receiving the beam. Two brace rods are associated with each leg assembly. Each rod has an end removably attachable to the beam for bracing the leg assembly relative to the beam with the beam support ends of the legs in an upright position when the foot ends are on a horizontal surface.

Both pairs of legs, the saddle assemblies, and the rods are all sized to fit, when disassembled, collectively inside the beam. This sawhorse is very stable when assembled and yet is easy to assemble without tools and is inexpensive to make. The beam, which serves the dual purpose of being a work beam and a storage container, is securely held on the leg assemblies while being supported and gripped by the resilient saddle elements. The sawhorse of the invention is thus easy to transport or store and is robust enough when assembled to support relatively heavy loads. These and other features and advantages of the present invention will be apparent from the preferred embodiments described in the following detailed description and illustrated in the accompanying drawings.

DETAILED DESCRIPTION OF THE PREFERRED EMBODIMENT

Figure 1:
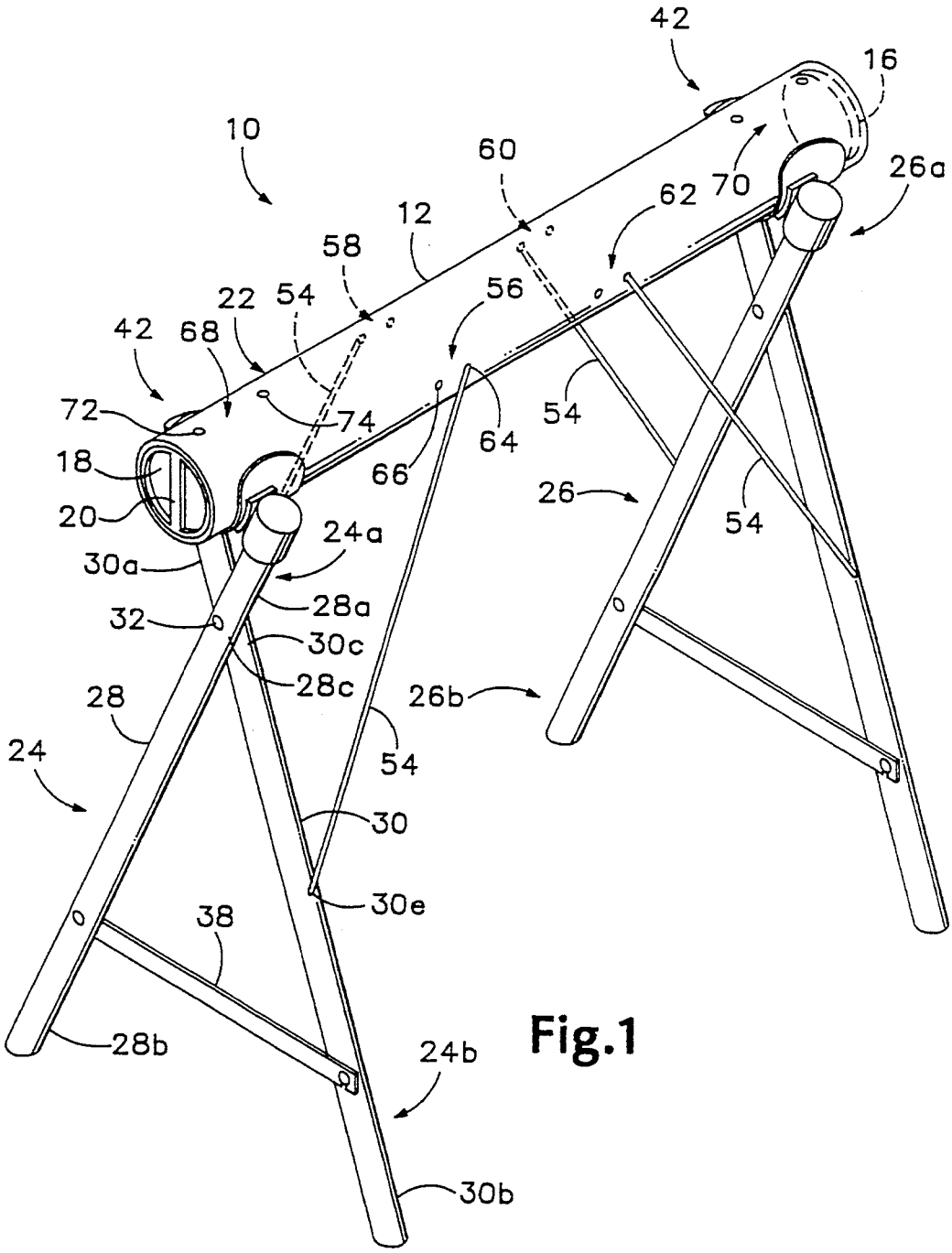
FIG. 1 is an isometric view of a sawhorse made according to the invention.
Figure 2:
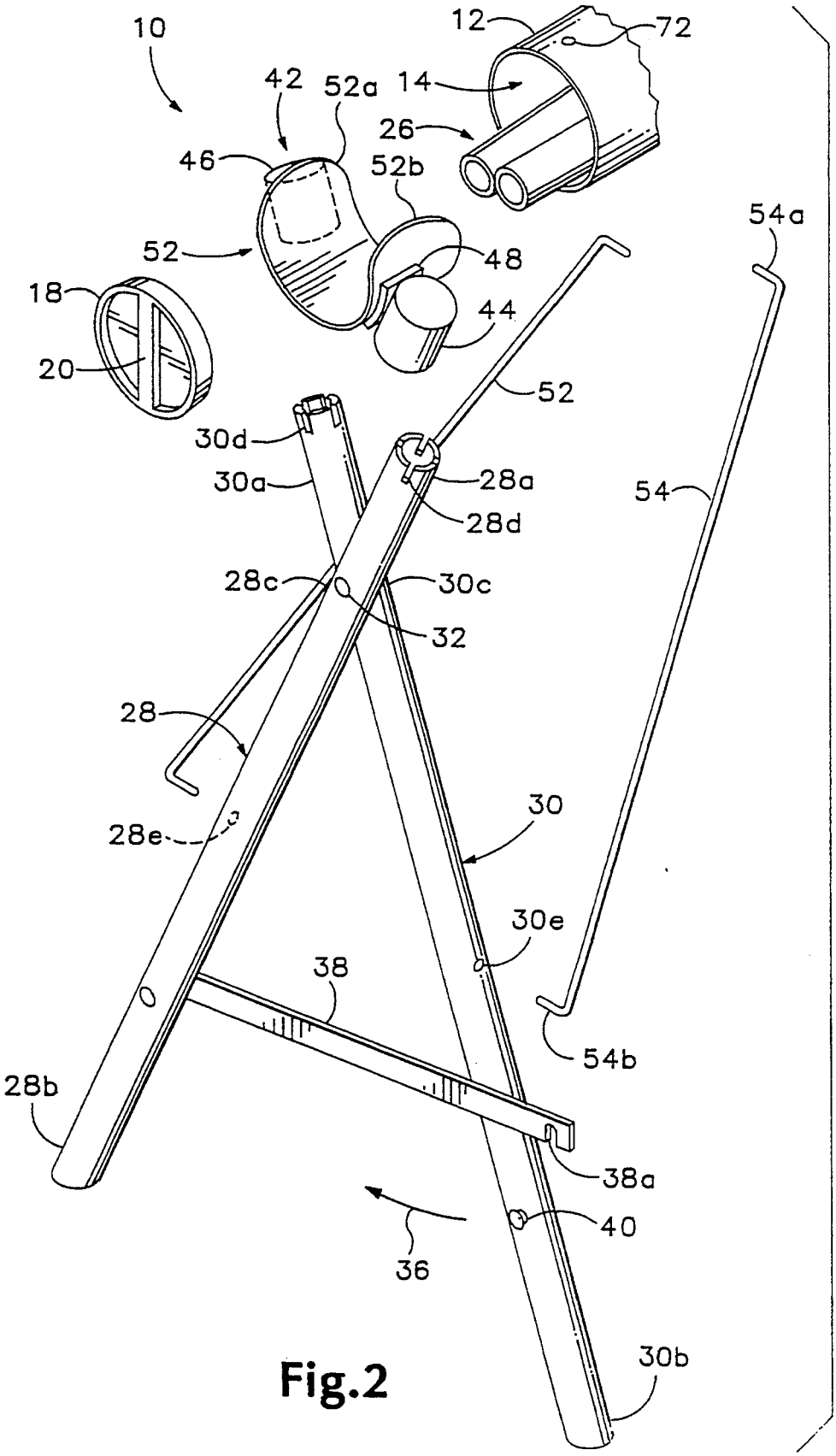
FIG. 2 is a fragmentary exploded view of one end of the sawhorse of FIG. 1.
Figure 3:
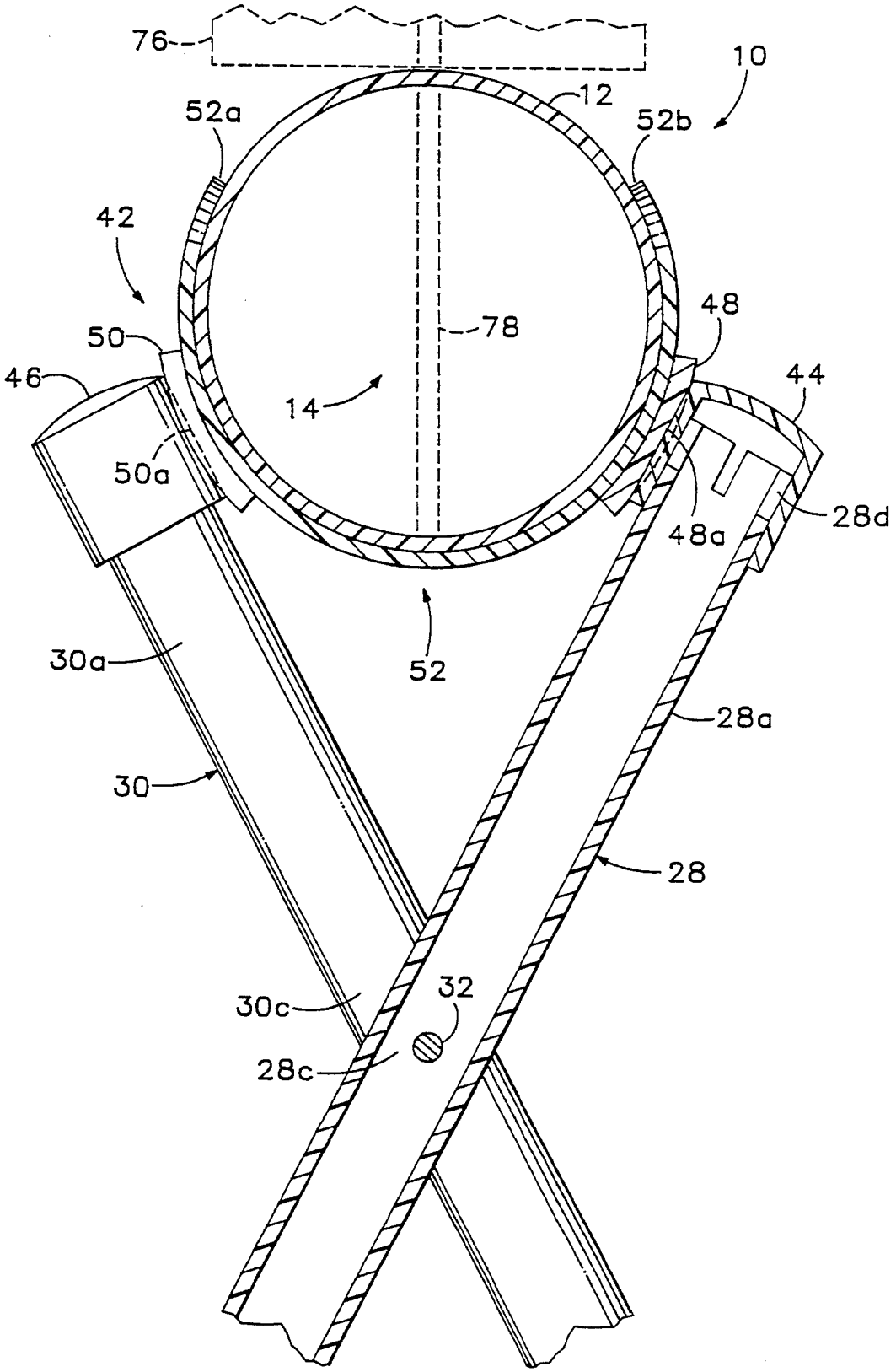
FIG. 3 is a cross section of a portion of the sawhorse of FIG. 1 illustrating the structure for supporting the work beam on a leg assembly.

Referring to FIGS. 1–3, the preferred embodiment of the present invention is shown as a sawhorse 10. Sawhorse 10 is intended for use primarily for supporting lumber for sawing, and may be used for any purpose in supporting a workpiece above a floor or other equivalent base surface. The sawhorse includes a work beam 12 made of 4-inch ABS schedule 40 plastic and has a length of three to four feet, as desired. Beam 12 is therefore hollow, having an internal chamber 14. One end 12*a* of the beam is closed by a fixed cap or plug 16. The other end 12*b* is selectively closeable by a removable cap 18 received in the end of the beam with a snug friction fit. Cap 18 preferably has a handle 20 fixed to it to facilitate manipulation of the cap. Alternatively, a finger hole may be cut in the cap. Beam 12, plug 16 and cap 18 therefore form a container 22.

Opposite ends 12*a* and 12*b* of the beam are supported by respective identical leg assemblies 24 and 26. These leg assemblies have upper or beam-support ends 24a and 26a, and lower or foot ends 24b and 26b, respectively. Each leg assembly includes two identical legs 28 and 30 having corresponding upper or beam-support ends 28a and 30a, and lower or foot ends 28b and 30b. The legs are preferably made of 1-inch Schedule 40 PVC with a length of about 2½-feet, although this length can be varied. However, in order to accommodate stowing the parts of the sawhorse in container 22, the legs must be sufficiently shorter than the beam to allow the various parts to be placed therein.

Legs 28 and 30 are pivotingly connected at intermediate points 28c arid 30c, located about one third of the length of the legs from the upper ends, by pivot pin 32. This pivot pin allows the legs to be folded together in parallel relationship, as is represented by arrow 36, for placement in container 22 as shown in FIG. 2.

One end of a cross bar 38 is pivotingly mounted on leg 28. The other end has a side notch 38a that receives a latch pin 40 mounted in the side of leg 30, as shown. Cross bar 38 serves to keep the foot ends of the legs from spreading when heavy loads are applied to the sawhorse.

Removably mounted on the upper ends of the pair of legs of each leg assembly is a saddle assembly 42. Each saddle assembly includes conventional PVC end caps 44 and 46 which fit snugly on the ends of legs 28 and 30, respectively. The upper end of each of the legs also preferably has a plurality of axial slits, such as slits 28d and 30d in legs 28 and 30. These slits allow the ends to flex radially inwardly when caps 44 and 46 are inserted over them, assuring close surface contact between the leg and the cap. Conventional PVC caps taper inwardly toward the closed end. If saddle assembly 42 were to be made as an integral unit using injection molding, the caps could be made with a constant diameter. In such a case it would be preferable not to have slits on the upper ends of the legs.

The outer sides of the caps are attached, such as with a conventional general-purpose plastic adhesive, to respective mounting plates 48 and 50, which have outer cavities 48a and 50a that conform with the round sides of caps. These cavities provide increased surface contact between the cap and the mounting plate.

The mounting plates are preferably formed of pieces of 4-inch ABS pipe so that they have a curvature that conforms with the work beam. An arcuate saddle element 52, formed of 4-inch diameter PSM SDR 35 PVC sewer pipe, is in turn attached to mounting plates 48 and 50 so that the associated caps are aligned with the upper ends of legs 28 and 30 when crossed at the angle shown. The caps thus provide means for attaching the saddle element to the associated legs.

Saddle element 52 is preferably about 3-inches wide and extends circumferentially along an arc of about 220°. By making the arc greater than 180° long, the tips 52a and 52b must flex outwardly to allow the beam to be inserted in place. Since the saddle element is relatively thin it is resilient enough to flex to allow the beam to be inserted between the saddle element tips. Alternatively, the beam can be inserted into the saddle element by sliding the saddle element in from the end of the beam. Either way, since the saddle element has the same nominal diameter as the beam, the saddle element is flexed outwardly slightly when the beam is received in it. This assures a tight frictional grip by the saddle element on the beam during use.

Tips 52a and 52b of the saddle element are curved. This curvature allows the arc-length of the saddle element to be as long as possible while allowing them to be inserted into beam 12 lengthwise during storage and transport.

Sawhorse 10 also includes four ¼-inch diameter, 1½-feet long leg-brace rods 54 providing means for securing the leg assemblies relative to the beam. These brace rods have ends with respective 90° elbows and laterally extending 1-inch terminal fingers 54a and 54b. In the middle of each leg is a ¼-inch hose facing outwardly, such as holes 28e and 30e. These holes receive one of the end fingers of a brace rod.

The work beam also has four sets 56, 58, 60 and 62 of two ¼-inch holes, such as holes 64 and 66 in set 56. The two holes are spaced axially 1-inch apart and approximately 1½-feet from an associated end of the beam. Sets 56 and 58 are opposite each other, and sets 60 and 62 are opposite each other.

Beam 12 must be placed in the saddle assemblies so that the sets of holes are on the sides of the beam. By providing pairs of holes, it does not matter which set of holes is on which side of the beam. Further, it does not matter which leg of each leg assembly goes in each cap of the saddle assembly.

The corresponding finger of the brace rod associated with the leg that is closer to the length-wise center of the beam is placed in the hole that also is closer to the center of the beam. Similarly, the finger of the brace rod associated with the leg that is closer to the end of the beam is placed in the hole of the associated set of holes that is closer to the end of the beam. When in place, these brace rods securely hold the associated leg assemblies in a vertical orientation.

Beam 12 also preferably has four additional sets of ¼-inch holes, two sets 68 and 70 shown in FIG. I are on the top ends of the beam. It is also necessary to have a set of lower holes (not shown) aligned with and opposite from the holes in set 70. Although not necessary, it is also convenient to have a set of lower holes (also not shown) aligned with and opposite from the holes 72 and 74 in set 68. Holes 72 and 74 are preferably about 1-inch arid 4-inches, respectively, from the end of the beam.

These upper and lower sets of holes are useful for attaching a board, such as board 76, a portion of which is shown in phantom lines in FIG. 3. Board 76 is attached to beam 12 by using corresponding sets of ¼-inch bolts and nuts, including bolt 78 also shown in phantom lines in FIG. 3.

The bolt heads are preferably countersunk so they set below the surface of board 76. Board 76 thus provides an upper planar work surface, if desired. Also, since it is common during cutting to cut into the work beam, the use of the board protects beam 12.

Since cap 18 is removable, nuts can easily be attached to bolts passing through holes 72 and 74. Thus, the lower aligned holes need not be used. However, it would be very difficult to attach nuts to bolts passing only through set 70 of holes since that end is closed. Thus long bolts, such as bolt 78, passing through the lower set of holes, allows for attaching the nuts to the bolts on the outside bottom of the beam. By having all four sets of upper and lower holes either surface of the beam may be oriented upwardly during assembly Disassembly and storage The sawhorse is used as shown in FIG. 1. If it is desired to collapse the sawhorse and store it according to the invention, the work beam is first snapped out of saddle elements 52 of each saddle assembly. The leg cross bars 38 are then released from the associated latch pin 40. The fingers of the brace rods 54 are then removed from the associated holes in the leg and beam. The upper leg ends are then removed from the caps in the saddle assemblies. The parts of the sawhorse are now separated.

The legs of each leg assembly are pivoted so that the legs are substantially parallel to each other. Cross bar 38 and latch pin 40 prevent the legs from reaching truly parallel alignment. End cap 18 is then removed from the end of the beam by grasping handle 20 and pulling firmly away from the end of the beam. The two leg assemblies and the four brace rods are then inserted collectively into chamber 14 and positioned next to plug 16. FIG. 2 shows leg assembly 26 being put in chamber 14. This leaves space in the open end of the chamber for placing the two saddle assemblies.

Cap 18 is then replaced, securing the various sawhorse parts inside the beam, which with the end caps forms container 22. It is then a matter of simply transporting or storing the container without having to keep track of the individual parts. The only requirement is that the leg assemblies, saddle assemblies, and brace rods be sized to all fit within chamber 14.

By constructing sawhorse 10, with the exception of the brace rods, cross bar, latch pin and pivot pin, out of commonly available plastic pipes, sawhorse 10 is lightweight, and easy and inexpensive to manufacture. Further, the simplicity of the design, particularly accomplished with the use of the preferred saddle assemblies, also makes the sawhorse easily assembled and disassembled without any hand tools. When assembled, the sawhorse is very rigid and will support relatively heavy loads.

It will be apparent to one skilled in the art that variations in form and detail may be made in the preferred embodiment without varying from the spirit and scope of the invention as defined in the claims and any modification of the claim language or meaning as provided under the doctrine of equivalents.

For instance, the shape of the beam can take any convenient form that provides an inner chamber. Any attaching device or securing structure that secures the leg assemblies to the beam may be employed if the benefits of the saddle element are not desired. The use of a tubular beam and an arcuate saddle element provides ease of assembly and secure attachment of the beam to the leg assemblies, but may have other configurations which provide similar functions and advantages. The preferred embodiment is thus provided for purposes of explanation and illustration, but not limitation.

I claim:

1. A sawhorse comprising:

a hollow elongate cylindrical work beam;

a pair of legs associated with each end of the work beam and having spaced-apart feet and spaced-apart upper ends;

a saddle assembly also associated with each end of the work beam for supporting an associated pair of legs relative to the work beam, each saddle assembly including a unitary saddle element made of a cylindrical resilient material, and having a continuous arc with a circumference greater than 180° and less than 360°, thereby having an open side, and a diameter corresponding to the diameter of the beam for conforming the saddle element with the beam, the saddle element being sufficiently resilient to allow the beam to be inserted through the open side, the saw horse being capable of being disassembled and the pairs of legs and the saddle assemblies being sized to be stowed in the work beam.

2. A sawhorse according to claim 1 wherein the legs in each pair of elongate legs are pivotingly joined at a position intermediate the ends of the legs, each saddle element has an outer surface, and each saddle assembly includes means mounted on the outer surface of the associated saddle element for attaching the saddle element to the upper ends of the associated legs with the legs being removable from the attaching means.

3. A sawhorse according to claim 2 wherein the attaching means includes downwardly directed caps mounted on opposite sides of each saddle element that fit over the upper ends of the legs.

4. A sawhorse according to claim 1 wherein each saddle element has a longitudinal length that is less than the diameter of the beam and the saddle assembly is otherwise sized to be stowed in the beam with the saddle element turned sideways.

5. A collapsible, self-stowing sawhorse comprising:

an elongate, hollow, cylindrical, and rigid work beam;

a cover covering each end of the beam, at least one of the covers being removable for providing access to the interior of the beam;

a pair of elongate legs for each end of the work beam that are shorter than the work beam and have foot ends and beam-support ends;

means for pivotingly coupling the pair of legs together at an intermediate point of each leg, the legs being pivotable for aligning each pair of legs;

a saddle assembly for each pair of legs for holding the beam between spaced-apart beam-support ends of the legs, the saddle assembly including caps removably mountable on the beam-support ends of the legs and an upwardly open cylindrical saddle element having an outer surface, a circumferential length greater than 180°, a diameter corresponding to the diameter of the beam, and a longitudinal length less than the diameter of the beam, the caps being attached to the outer surface of the saddle element at spaced-apart locations, and the saddle element being sufficiently resilient for allowing the work beam to be inserted through the upward opening; and at least one rod associated with each pair of legs, each rod having an end removably attachable to the beam for bracing the pair of legs relative to the beam with the beam-support ends of the legs in an upright position supported in the caps of the associated saddle assembly;

both pairs of legs, when aligned, the saddle assemblies, when turned sideways, and the rods being sized to fit, when disassembled, collectively inside the beam.

* * * * *